US010896658B1

(12) United States Patent
Schweitzer, III et al.

(10) Patent No.: US 10,896,658 B1
(45) Date of Patent: Jan. 19, 2021

(54) VIRTUAL DISPLAY

(71) Applicant: Schweitzer Engineering Laboratories, Inc., Pullman, WA (US)

(72) Inventors: Edmund O. Schweitzer, III, Pullman, WA (US); Tony J. Lee, Henderson, NV (US); Krishnanjan Gubba Ravikumar, Pullman, WA (US); Lisa Gayle Nelms, Colfax, WA (US)

(73) Assignee: Schweitzer Engineering Laboratories, Inc., Pullman, WA (US)

( * ) Notice: Subject to any disclaimer, the term of this patent is extended or adjusted under 35 U.S.C. 154(b) by 0 days.

(21) Appl. No.: 16/838,594

(22) Filed: Apr. 2, 2020

(51) Int. Cl.
*G09G 5/00* (2006.01)

(52) U.S. Cl.
CPC ..... *G09G 5/006* (2013.01); *G09G 2354/00* (2013.01); *G09G 2370/06* (2013.01); *G09G 2370/16* (2013.01)

(58) Field of Classification Search
CPC G06F 1/12; H02H 1/0061; H02H 3/05; H02J 13/00016; H02J 13/00018; H02J 13/0004; H02J 13/0062; H02J 13/0079; H02J 13/0086; H02J 2310/64; H02J 3/005; Y02B 70/3225; Y04S 20/222; Y04S 50/10
See application file for complete search history.

(56) References Cited

U.S. PATENT DOCUMENTS 6,396,279 B1 5/2002 Gruenert
6,608,493 B2 8/2003 Hensler
6,795,789 B2 9/2004 Vandiver
6,847,297 B2 1/2005 Lavoie
6,892,115 B2 5/2005 Berkcan
6,892,145 B2 5/2005 Topka
6,909,942 B2 6/2005 Andarawis
6,985,784 B2 1/2006 Vandevanter
6,999,291 B2 2/2006 Andarawis
7,012,421 B2 3/2006 Lavoie
7,043,340 B2 5/2006 Papallo
7,058,481 B2 6/2006 Jiang
(Continued)

OTHER PUBLICATIONS

David Costello: Understanding and Analyzing Event Report Information, Oct. 2000.

(Continued)

*Primary Examiner* — Insa Sadio
(74) *Attorney, Agent, or Firm* — Jared L. Cherry

(57) ABSTRACT

The present disclosure pertains to systems and methods for generating a virtual display using a unidirectional communication channel. In one embodiment, a system may comprise a transmitting device including a processing subsystem to generate a representation of an encoded signal comprising information to be displayed on a virtual display. A virtual display transmission subsystem may transmit the encoded signal. A receiving device may comprise a virtual display reception subsystem to receive the encoded signal. A processing subsystem may extract the information to be displayed on the virtual display from the encoded signal and generate a representation of the virtual display. A virtual display subsystem may display the representation of the virtual display. The virtual display transmission subsystem and the virtual display reception subsystem may create a unidirectional communication channel from the transmitting device to the receiving device.

20 Claims, 4 Drawing Sheets

(56) References Cited

U.S. PATENT DOCUMENTS

| | | | | |
|---|---|---|---|---|
| 7,058,482 | B2 | 6/2006 | Fletcher | |
| 7,068,483 | B2 | 6/2006 | Papallo | |
| 7,068,612 | B2 | 6/2006 | Berkcan | |
| 7,111,195 | B2 | 9/2006 | Berkcan | |
| 7,117,105 | B2 | 10/2006 | Premerlani | |
| 7,151,329 | B2 | 12/2006 | Andarawis | |
| 7,254,001 | B2 | 8/2007 | Papallo | |
| 7,259,565 | B2 | 8/2007 | Diercks | |
| 7,262,943 | B2 | 8/2007 | Stellato | |
| 7,301,738 | B2 | 11/2007 | Pearlman | |
| 7,460,590 | B2 | 12/2008 | Lee | |
| 7,532,955 | B2 | 5/2009 | Dougherty | |
| 7,636,616 | B2 | 12/2009 | Fletcher | |
| 7,693,607 | B2 | 4/2010 | Kasztenny | |
| 7,747,354 | B2 | 6/2010 | Papallo | |
| 7,747,356 | B2 | 6/2010 | Andarawis | |
| 7,986,503 | B2 | 7/2011 | Papallo | |
| 8,024,494 | B2 | 10/2011 | Soed | |
| 8,213,144 | B2 | 7/2012 | Papallo | |
| 8,310,373 | B2 | 11/2012 | Feight | |
| 8,560,255 | B2 | 10/2013 | Elwarry | |
| 8,891,963 | B2 | 11/2014 | Patel | |
| 8,936,194 | B1 | 1/2015 | Welch | |
| 9,047,279 | B1 | 6/2015 | Welch | |
| 9,366,711 | B2 | 6/2016 | Klapper | |
| 9,632,147 | B2 | 4/2017 | Hensler | |
| 9,766,615 | B2 | 9/2017 | Baumann | |
| 9,819,611 | B2 | 11/2017 | Snowdon | |
| 9,838,832 | B2 | 12/2017 | Vasko | |
| 10,108,181 | B2 | 10/2018 | Baumann | |
| 10,178,047 | B2 | 1/2019 | Chapman | |
| 10,348,065 | B1 | 7/2019 | Libby | |
| 10,366,265 | B2 | 7/2019 | Agarwal | |
| 10,379,991 | B2 | 8/2019 | Yang | |
| 2003/0048508 | A1 | 3/2003 | Yu | |
| 2004/0133814 | A1* | 7/2004 | Lavoie | H02J 13/0004 713/300 |
| 2009/0012728 | A1 | 1/2009 | Spanier | |
| 2009/0296583 | A1 | 12/2009 | Dolezilek | |
| 2010/0040068 | A1 | 2/2010 | Wimmer | |
| 2010/0183298 | A1 | 7/2010 | Biegert | |
| 2016/0013632 | A1 | 1/2016 | Lloyd | |
| 2017/0026291 | A1 | 1/2017 | Smith | |
| 2017/0288950 | A1 | 10/2017 | Manson | |
| 2017/0338659 | A1* | 11/2017 | Bhowmik | H02S 50/00 |
| 2018/0034689 | A1 | 2/2018 | Kanabar | |
| 2018/0089057 | A1 | 3/2018 | Yang | |
| 2018/0348267 | A1 | 12/2018 | Yang | |

OTHER PUBLICATIONS

Joe Perez: A Guide to Digital Fault Recording Event Analysis, 2010.
Considerations for Use of Disturbance Recorders; a Report to the System Protection Subcommittee of the Power System Relaying Committee of the IEEE Power Engineering Society, Dec. 27, 2006.
David Costello: Event Analysis Tutorial, Part 1: Problem Statements 2011.
Jane Starck, Antti Hakala-Ranta, Martin Stefanka, Switchgear Optimization Using IEC 61850-9-2 and Non-Conventional Measurements May 23, 2012.
Will Allen, Tony Lee: Flexible High-Speed Load Shedding Using a Crosspoint Switch Oct. 2005.
Qiaoyin Yang, Rhett Smith: Improve Protection Communications Network Reliability Throught Software-Defined Process Bus, Jan. 2018.
Caitlin Martin, Steven Chase, Thanh-Xuan Nguyen, Dereje Jada Hawaz, Jeff Pope, Casper Labuschagne: Bus Protection Considerations for Various Bus Types; Oct. 2013.
SEL-2924/SEL-2925 Bluetooth® Serial Adapters, Instruction Manual, Schweitzer Engineering Laboratories Inc., Aug. 2015.
VIP Services® Virtual Information Portal, Wunderlich-Malec, Feb. 2018.
Digital Tapchanger Control TCC300, Digital Tapchanger Control for Transformers and Regulators, Descriptive Bulletin, ABB, Mar. 2017.
Simon Loo: Using the RxTx App on an Android™ Tablet to Connect With SEL Devices Via the SEL-2924; SEL Application Guide vol. 2 AG2014-14, Apr. 2014.
Littelfuse® Informer; Protection Relays, Remote Indication and Monitoring; Rev: 1-B-043019; May 2019.
Littelfuse® MP800; Protection Relays and Controls, Motor and Pump Protection—Single and 3-Phase; Rev: 2-C-43019; May 2019.
Littelfuse® 235P; Protection Relays, Motor and Pump Protection; Rev: 2-C-042619; Apr. 2019.
Littelfuse® 232-Insider; Protection Relays, Motor and Pump Protection; Rev: 2-C-042619; Apr. 2019.
Matt French: Electrical Control Panel QR Codes; AMPS Industrial Controls; Jul. 2018. retrieved from https://ampsic.com/electrical-control-panel-qr-codes/ on Sep. 22, 2020.

* cited by examiner

VIRTUAL DISPLAY

TECHNICAL FIELD

This disclosure relates to systems and methods for generating a virtual display using a unidirectional communication channel. The present disclosure may be applied in high-security applications, such as critical infrastructure systems.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

Figure 1:
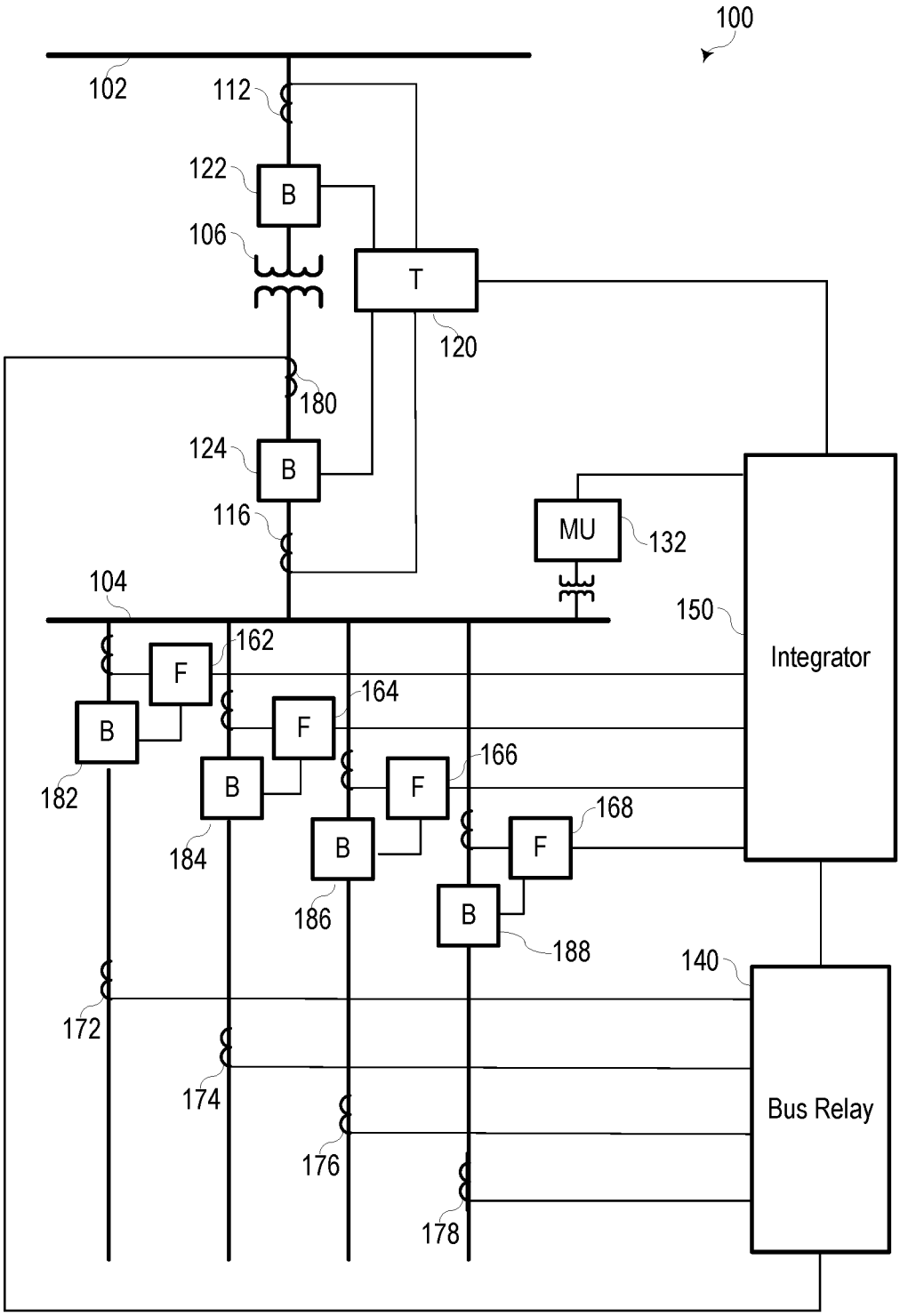
FIG. 1 illustrates a simplified one-line diagram of a portion of an electric power system consistent with embodiments of the present disclosure.

Prevention of unauthorized access and modification of critical infrastructure and other high-security systems is of significant concern due to the potential disruption that could be caused by unauthorized access to such systems. The need for security associated with such devices may increase the burden and complexity associated with extracting and using information contained in such devices. For example, security requirements may limit the ability of operators to connect commonly available devices (e.g., smartphones, tablets, and laptops) to the critical infrastructure system because the ability to temporarily connect devices may introduce security risks.

The inventors of the present disclosure have recognized that various advantages may be achieved by utilizing a virtual display to display information from a transmitting device. The systems and methods disclosed herein may be employed in a variety of contexts, including critical infrastructure and other high-security systems. In such applications, operators of critical infrastructure systems may make use of commonly available devices without opening a critical infrastructure system to communicate with unknown devices.

Still further, the systems and methods disclosed herein may also increase reliability because a failure of a display element may require repair or replacement. Such repairs or replacement may require that systems be taken offline, thus creating disruption and increasing the cost and effort of maintenance over time. Although detactable displays may also avoid the need to take systems offline, integrated displays are more commonly used. The systems and methods disclosed herein may allow for the transmission of information from a transmitting device that lacks a display element.

In various embodiments consistent with the present disclosure, a wireless unidirectional communication interface may be embodied using a transmitter in a transmitting device and a receiver in a receiving device. In various embodiments, a transmitting device system may include an optical transmitter that encodes information into an optical signal that provides information from the device. A receiving device may include an optical receiver to receive and interpret the encoded signal.

In some embodiments, the transmitting device may lack an optical receiver, and as such, the data transmission is unidirectional. A unidirectional communication channel may be used in various embodiments consistent with the present disclosure to reduce potential security risks while providing added convenience and simplifying the process of obtaining information from critical infrastructure and other high-security systems. Many bidirectional communication protocols and interfaces supported by commonly available devices (e.g., WiFi, Bluetooth, etc.) add implementation complexity and may introduce security risks.

User input may, in certain embodiments, be limited to physical interfaces (e.g., buttons, switches, and the like) on the device in the critical infrastructure system. The use of a unidirectional transmitter and a physical interface may allow an operator to interact with a device without subjecting the device to the potential for a remote attack that involves changes to the relay setting. The use of an optical transmitter may also reduce the ability for attackers to intercept the signal because optical signals are significantly more attenuated by physical barriers (e.g., walls) than other types of signals (e.g., Bluetooth, WiFi, etc.) commonly used to transmit data. As such, the physical security of the device may be used to enhance the security of the systems disclosed herein.

In one specific example, the systems and methods disclosed herein may be embodied in an intelligent electronic device (IED) operating in an electrical power system. An optical receiver may receive the signal and provide the signal to a portable device (e.g., a smartphone, tablet, or laptop). The optical signal may include a wide variety of information that can be used by operators of the device. For example, the information may include electrical parameter values, status information, a model number, a serial number, a firmware version, event reports, change logs, a battery status, etc. Based on various identifiers (e.g., a serial number, a firmware version, etc.), an operator may access information about the device, such as instruction manuals, updates, configuration information, and the like from various external sources (e.g., the Internet, a private network, etc.) to retrieve information about the transmitting device.

As used herein, an IED may refer to any microprocessor-based device that monitors, controls, automates, and/or protects monitored equipment within a system. Such devices may include, for example, remote terminal units, differential relays, distance relays, directional relays, feeder relays, overcurrent relays, voltage regulator controls, voltage relays, breaker failure relays, generator relays, motor relays, automation controllers, bay controllers, meters, recloser controls, communications processors, computing platforms, programmable logic controllers (PLCs), programmable automation controllers, input and output modules, and the like. The term IED may be used to describe an individual IED or a system comprising multiple IEDs. Embedded devices may comprise relatively simple devices to perform a specific function. Such devices may include, for example, contact sensors, status sensors, light sensors, tension sensors, and the like.

The embodiments of the disclosure will be best understood by reference to the drawings. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor do the steps need to be executed only once, unless otherwise specified.

In some cases, well-known features, structures, or operations are not shown or described in detail. Furthermore, the described features, structures, or operations may be combined in any suitable manner in one or more embodiments. It will also be readily understood that the components of the embodiments, as generally described and illustrated in the figures herein, could be arranged and designed in a wide variety of different configurations. For example, throughout this specification, any reference to "one embodiment," "an embodiment," or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Several aspects of the embodiments disclosed herein may be implemented as software modules or components. As used herein, a software module or component may include any type of computer instruction or computer-executable code located within a memory device that is operable in conjunction with appropriate hardware to implement the programmed instructions. A software module or component may, for instance, comprise one or more physical or logical blocks of computer instructions, which may be organized as a routine, program, object, component, data structure, etc., that performs one or more tasks or implements particular abstract data types.

In certain embodiments, a particular software module or component may comprise disparate instructions stored in different locations of a memory device, which together implement the described functionality of the module. Indeed, a module or component may comprise a single instruction or many instructions and may be distributed over several different code segments, among different programs, and across several memory devices. Some embodiments may be practiced in a distributed computing environment where tasks are performed by a remote processing device linked through a communications network. In a distributed computing environment, software modules or components may be located in local and/or remote memory storage devices. In addition, data being tied or rendered together in a database record may be resident in the same memory device, or across several memory devices, and may be linked together in fields of a record in a database across a network.

Embodiments may be provided as a computer program product including a non-transitory machine-readable medium having stored thereon instructions that may be used to program a computer or other electronic device to perform processes described herein. The non-transitory machine-readable medium may include, but is not limited to, hard drives, floppy diskettes, optical disks, CD-ROMs, DVD-ROMs, ROMs, RAMs, EPROMs, EEPROMs, magnetic or optical cards, solid-state memory devices, or other types of media/machine-readable media suitable for storing electronic instructions. In some embodiments, the computer or another electronic device may include a processing device such as a microprocessor, microcontroller, logic circuitry, or the like. The processing device may further include one or more special-purpose processing devices such as an application-specific interface circuit (ASIC), PAL, PLA, PLD, field-programmable gate array (FPGA), or any other customizable or programmable device.

FIG. 1 illustrates a simplified one-line diagram of a portion of an electric power system 100 consistent with embodiments of the present disclosure. A plurality of primary protective relays 120, 140, 162, 164, 166, and 168 automate, monitor, and protect electric power system 100. The primary protective relays 120, 140, 162, 164, 166, 168 are critical infrastructure because maloperation of the relays may interrupt electrical service and/or damage the electric power system 100. Accordingly, stringent security policies may be applied to prevent an unauthorized individual or entity from gaining unauthorized access to or control of primary protective relays 120, 140, 162, 164, 166, and 168.

An integrator 150 may coordinate the operation of various devices in electric power system 100. The integrator 150 may receive information from a variety of devices and may implement consistent security policies across system 100. If the integrator 150 is unavailable or if an operator is working directly with one of the primary protective relays 120, 140, 162, 164, 166, 168, the systems and methods disclosed herein may be utilized to obtain information from one or more of the primary protective relays 120, 140, 162, 164, 166, and 168.

Integrator 150 may provide information to other systems (e.g., a supervisory control and data acquisition ("SCADA") system (not shown), a Wide-Area Situational Awareness (WASA) system (not shown), and the like. Further, integrator 150 may provide a communication gateway to system 100. Integrator 150 may allow operators to access system 100 locally and/or remotely while enforcing strict security protocols and processes to prevent unauthorized access to primary protective relays 120, 140, 162, 164, 166, and 168.

Electric power system 100 includes equipment, such as a bus 102, which provides electric power to bus 104 via a transformer 106. Transformer 106 may step voltage from a high voltage to a lower voltage. A voltage transformer may be in communication with a merging unit (MU) 132. MU 132 may provide information from a voltage transformer to integrator 150 in a format useable by integrator 150. Various feeders extend from bus 104 for delivering electric power to distributed loads. Circuit breakers 122, 124, 182, 184, 186, and 188 may be used to selectively connect and disconnect portions of the electric power system 100 for various purposes such as reconfiguration, protection in the event of a fault, or the like.

A plurality of feeder relays 162, 164, 166, and 168 may obtain current signals from a corresponding plurality of feeders and may provide overcurrent, directional, distance, overfrequency, underfrequency, and other protection to the feeders. Feeder relays 162, 164, 166, and 168 may provide information to integrator 150.

Transformer relay 120 may protect transformer 106. Transformer relay 120 may obtain current signals from both sides of the transformer 106 using CTs 112 and 116. Transformer relay 120 may provide differential protection, overcurrent protection, overfrequency protection, underfrequency protection, and other various protection for the transformer 106. Transformer relay 120 may further provide information to integrator 150, including current measurements gathered from CTs 112 and 116.

A bus relay 140 may be an IED configured to determine operating conditions on a zone that includes bus 104 and provide signals to implement a protection scheme. Bus relay 140 may obtain current signals related to electric power entering the bus 104 from integrator 150 or transformer relay 120. Bus relay 140 may also receive signals related to electric power leaving bus 104 on the feeders from CTs 172, 174, 176, 178, and 180. Bus relay 140 may provide differential protection, overvoltage protection, and other types of protection for the zone including the bus 104. Bus relay 140 may provide information to integrator 150.

The relays in system 100 may be in communication with various circuit breakers 122, 124, 182, 184, 186, and 188 to provide signals to the circuit breakers and receive status information from the circuit breakers. Upon receiving an "open" signal, the circuit breakers 122, 124, 182, 184, 186, and 188 may open. For example, upon detection of an overcurrent condition on the first feeder, integrator 150 may signal feeder relay 162 to open breaker 182 to remove current from the faulted feeder. Alternatively, feeder relay 162 may actuate breaker 182 independent of integrator 150.

In various embodiments, integrator 150 may also provide backup protection in the event of a failure. For example, as discussed above, transformer relay 120 may utilize measurements from CTs 112 and 116 to protect transformer 106.

When an operator needs to work with a specific relay or when integrator 150 is unavailable, the operator may use systems and methods consistent with the present disclosure. For example, an operator may need to obtain an event report from feeder relay 162. Using the systems and methods disclosed herein, an operator may use a mobile device to receive information from a wireless unidirectional communication system associated with feeder relay 162. In one specific embodiment, the wireless unidirectional communication system may comprise an infrared transmitter that transmits information to the operator's mobile device.

Figure 2:
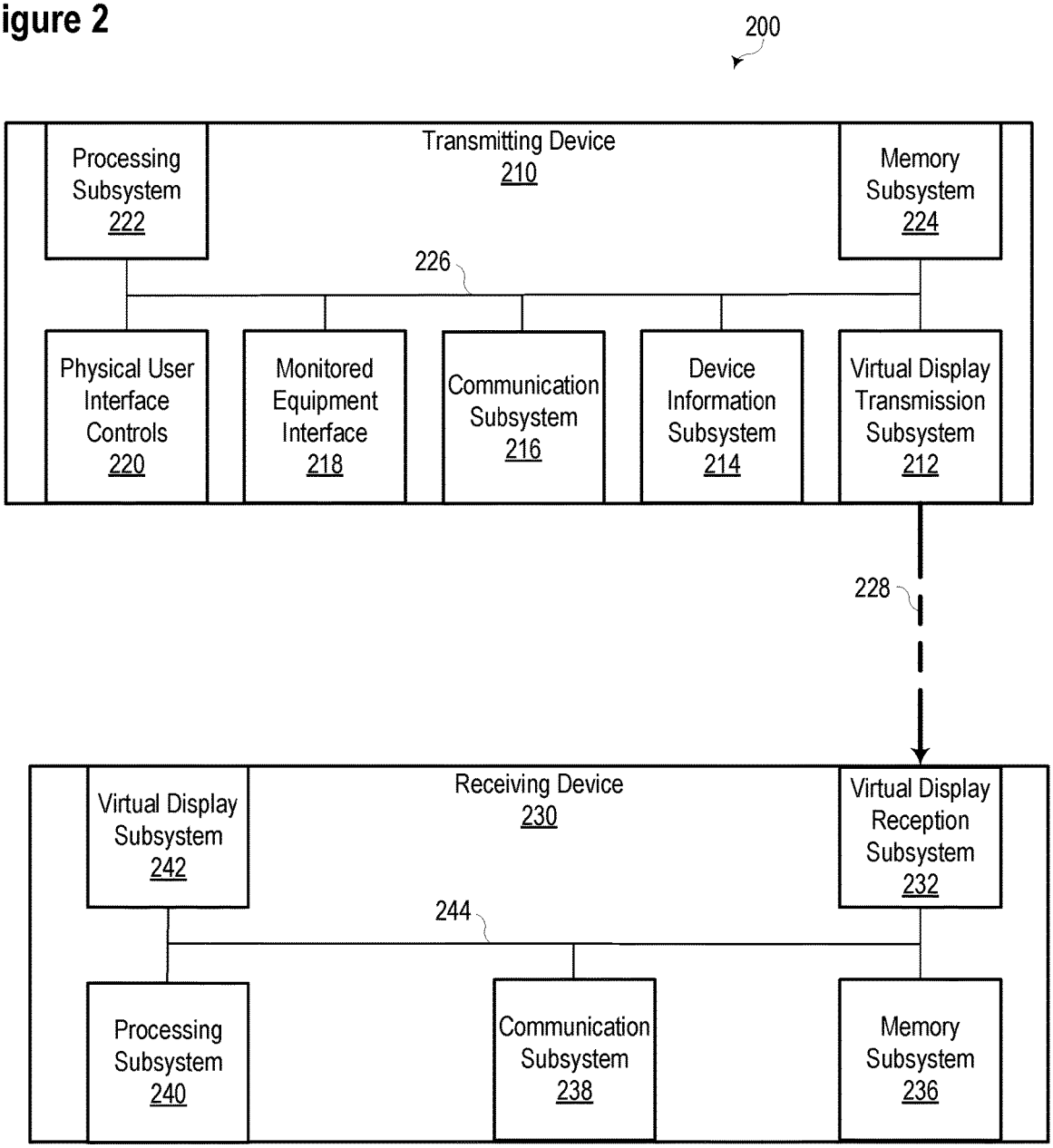
FIG. 2 illustrates a functional block diagram of a system comprising a receiving device that generates a virtual display based on an encoded signal received from a transmitting device consistent with embodiments of the present disclosure.

FIG. 2 illustrates a functional block diagram of a system 200 comprising a receiving device 230 that generates a virtual display based on an encoded signal 228 received from a transmitting device 210 consistent with embodiments of the present disclosure. Transmitting device 210 may comprise a variety of types of equipment used in critical infrastructure or other applications with strict security requirements. In one specific example, transmitting device 210 may comprise an IED in an electric power system. In other examples, system 200 may operate in communication systems (e.g., telephone systems, network systems, etc.), water distribution and treatment systems, security systems, etc. Receiving device 230 may comprise a smartphone, tablet, laptop computer, or another type of portable electronic device.

The transmitting device 210 may include a virtual display transmission subsystem 212 that generates a signal 228. The virtual display transmission subsystem 212 may transmit a wide variety of types of information about transmitting device 210. Virtual display transmission subsystem 212 may include a transmitter, a transmitter driver, and other circuitry and elements to physically create the encoded signal 228 based on a representation of the encoded signal received from processing subsystem 222.

Many types of transmission technologies, encodings, and protocols may be used in various embodiments. In one specific embodiment, virtual display transmission subsystem 212 may transmit an infrared signal or another type of optical signal. The use of an infrared signal may be beneficial because a transmitter may be obscured behind a material that is transparent to infrared signals. Accordingly, specific knowledge of the existence and location of the transmitter may be necessary to obtain information from transmitting device 210. In other embodiments, virtual display transmission subsystem 212 may transmit a visible light signal. The use of a visible light signal may be advantageous because it may allow an operator to easily locate the transmitter. Further, such a system may be implemented using one or more LEDs, which are commonly incorporated into many types of equipment. Such LEDs may provide status information or other types of information when virtual display transmission subsystem 212 is not in operation. Virtual display transmission subsystem 212 is illustrated as unidirectional because transmitting device 210 may lack a corresponding optical receiver or another type of receiver. Other types of transmitters are also contemplated (e.g., radio transmitters, etc.).

Transmitting device 210 includes a processing subsystem 222 that processes information and coordinates the operation of the other components of transmitting device 210. A data bus 226 may facilitate communication among various components of transmitting device 210. Instructions to be executed by processing subsystem 222 may be stored in memory subsystem 224. Processing subsystem 222 may operate using any number of processing rates and architectures. Processing subsystem 222 may be used to perform any of the various algorithms and calculations described herein. Processing subsystem 222 may be embodied as a general-purpose integrated circuit, an application-specific integrated circuit, a field-programmable gate array, and/or any other suitable programmable logic device. Such instructions may include transmitting information via virtual display transmission subsystem 212.

A device information subsystem 214 may receive and store information related to transmitting device 210 and/or equipment in communication with transmitting device 210. In various embodiments, information related to transmitting device 210 may include, among other things, configuration or settings information, a device name, a model number, a serial number, a firmware version, status information, instructions, battery status, etc. Still further, in some embodiments, the device information subsystem 214 may provide a link to resources not stored on transmitting device 210, such as a hyperlink to a support webpage for transmitting device 210. In still other embodiments, receiving device 230 may check for service bullitens or updates by automatically checking for updates once it receives the information identifying the transmitting device (e.g., a serial number, a model number, etc.). In such embodiments, an operator may be promptly presented with the latest list of service bullitens and/or updates for transmitting device 210. The hyperlink may include additional resources, such as tutorials, instructions, updates, and the like. Device information subsystem 214 may also receive and store information about equipment in communication with transmitting device 210. For example, if transmitting device 210 operates in an electric power system, device information subsystem 214 may receive and store electrical parameters (e.g., voltage measurements, current measurements, phase measurements, etc.). Information received or stored by device information subsystem 214 may be communicated via virtual display transmission subsystem 212.

A communication subsystem 216 may be in communication with other devices in the critical infrastructure system. In one specific embodiment, transmitting device 210 may comprise a protective relay operating in an electric power system and communication subsystem 216 may enable communication with an integrator, such as integrator 150 illustrated in FIG. 1. In various embodiments, communication subsystem 216 may communicate via a variety of communication links, including Ethernet, fiber optic, and other forms of data communication channels.

A monitored equipment interface 218 may be in communication with monitored equipment that is operable to control equipment in an electric power system. Monitored equipment subsystem 218 may issue commands to and/or receive status information from monitored equipment. In certain embodiments, monitored equipment subsystem 218 may be in communication with, for example, a circuit breaker and may issue commands to the circuit breaker to selectively connect or disconnect portions of the electric power system.

Physical user interface controls 220 may comprise inputs that an operator may utilize to interact with the transmitting device 210 through the virtual display. The physical user interface controls 220 may allow a user to navigate menus, adjust settings, and provide feedback based on information shown on the virtual display. The use of physical user interface controls 220 may reduce or eliminate the potential for an attacker to remotely interact with transmitting device 210, and instead, may take advantage of physical security (e.g., fences, walls, locks, etc.) that commonly protect critical infrastructure.

A virtual display reception subsystem 232 may receive encoded signal 228. The virtual display reception subsystem 232 may comprise a receiver to receive and extract information from encoded signal 228. Further, virtual display reception subsystem 232 may convert information comprised by the encoded signal 228 to a form used by other elements of receiving device 230. Virtual display reception subsystem 232 may be integrated into receiving device 230 or may comprise a peripheral device in communication with receiving device 230. For example, in one embodiment, virtual display reception subsystem 232 may comprise an infrared receiver that may be connected via a port (e.g., a universal serial bus (USB) port) or via another communication interface (e.g., Bluetooth) available on receiving device 230.

In some embodiments, encoded signal 228 may be transmitted through a dongle used to connect transmitting device 210 to receiving device 230. The dongle may provide certain advantages, such as facilitating alignment of the encoded signal 228 with a receiver in virtual display reception subsystem 232. Further, where multiple optical transmission subsystems may be operating in close proximity (e.g., in an electric power system substation), the use of a dongle may allow an operator to easily determine which device is generating encoded signal 228. In various embodiments, one end of the dongle may be permanently or semi-permanently attached to either the transmitting device 210 or the receiving device 230, and as such, the dongle may be readily accessible when needed. Of course, in other embodiments, the dongle may be removable from both the transmitting device 210 and the receiving device 230. In one specific embodiment, a dongle may be selectively connected to transmitting device 210 and/or receiving device 230 using magnets arranged to facilitate coupling and alignment.

Receiving device 230 includes a processing subsystem 240 that processes information and coordinates the operation of the other components of receiving device 230. A data bus 244 may facilitate communication among various components of receiving device 230. Instructions to be executed by processing subsystem 230 may be stored in memory subsystem 236. Processing subsystem 240 may operate using any number of processing rates and architectures. Processing subsystem 240 may be used to perform any of the various algorithms and calculations described herein. Processing subsystem 240 may be embodied as a general-purpose integrated circuit, an application-specific integrated circuit, a field-programmable gate array, and/or any other suitable programmable logic device. Such instructions may include receiving and processing information received via virtual display reception subsystem 232.

A communication subsystem 238 may allow receiving device 230 to communicate with a variety of other devices. In one embodiment, communication subsystem 238 may comprise a cellular modem or another type of network interface (e.g., a Wi-Fi adapter) that allows receiving device 230 to receive information about transmitting device 210. For example, encoded signal 228 may comprise a model number or other information about transmitting device 210. An operator may use the model number or other information (e.g., serial number, firmware version, etc.) to access information such as instructions, tutorials, updates, and the like while interacting with transmitting device 210.

A virtual display subsystem 242 may display information received from transmitting device 210. In various embodiments, such information may include parameter values, status information, a model number, a serial number, a firmware version, event reports, changelogs, etc. An operator may interact with transmitting device 210 based on information presented by virtual display subsystem 242 using physical user interface controls 220. In one specific embodiment, virtual display subsystem 242 may generate dynamic representations of information comprised within encoded signal 228. For example, encoded signal 228 may comprise information about a specific parameter in an electric power system, and virtual display subsystem 242 may generate a waterfall display or other type of display that shows a stream of status information over a period of time. In other embodiments, a real-time display, such as a phasor display, may be generated by virtual display subsystem 242.

Virtual display transmission subsystem 212 and virtual display reception subsystem 232 may create a unidirectional communication channel from the transmitting device 210 to the receiving device 230. In other words, information may be sent by transmitting device 210 to receiving device 230 through the unidirectional communication channel, but information may not be sent by receiving device 230 to transmitting device 210 using the unidirectional communication channel.

Figure 3:
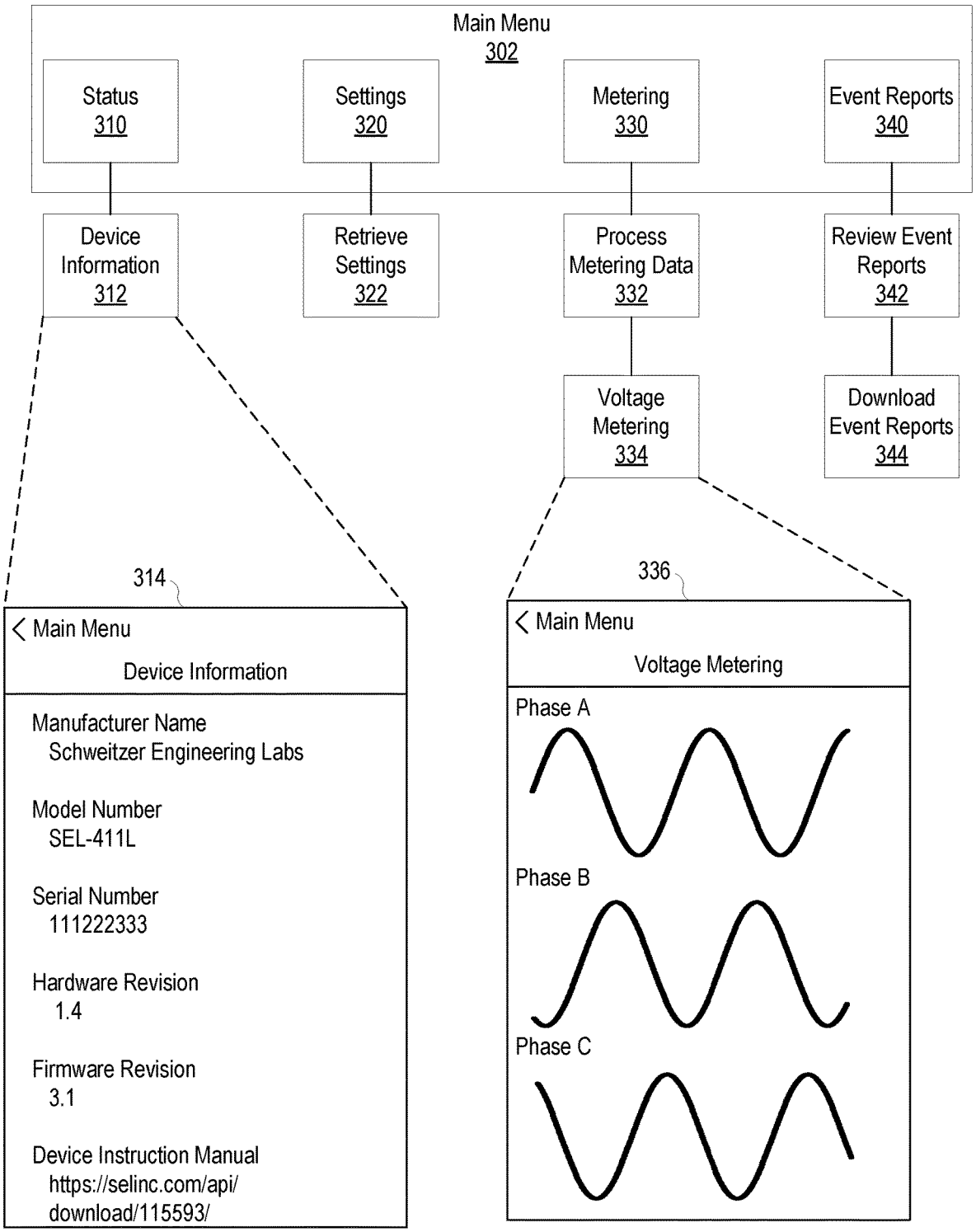
FIG. 3 illustrates a menu structure and representative screens of a virtual display consistent with embodiments of the present disclosure.

FIG. 3 illustrates a menu structure and representative screens of a virtual display consistent with embodiments of the present disclosure. A user of a virtual display may utilize an application on a smartphone, tablet, laptop, or another portable electronic device to interact with a device via a virtual display. A menu structure may provide various options to the user. In the illustrated embodiment, a main menu 302 includes four categories from which a user may select, namely: status 310, settings 320, metering 330, and event reports 340. The content shown on the virtual display may depend on the selections made by a user.

Using the status 310 option, a user may obtain information about a device. Such information may include the status of the device or the status of equipment monitored by the device. In one example, the device may include representations of information such as operational status, alarm status, communication status, and the like. The status 310 option may also allow a user to access device information 312. An example of the type of information that may be displayed is illustrated in representative screen 314. As shown, the device information 312 may identify a device manufacturer, a module number, a serial number, a hardware revision, a firmware revision, and a link to the device's instruction manual. The specific information provided may vary by the type of device and by the specific function of the device.

Using the metering 330 option may allow a user to process metering data 332 or display voltage metering 334. An example of the type of information that may be displayed using the voltage metering 334 option is illustrated in representative screen 336. Screen 336 illustrates the voltages of a three-phase power system over a period of time. Additional information may also be provided in alternative embodiments (e.g., frequency measurements, peak-to-peak voltage, etc.) or on other screens. Screen 336 is merely representative of one screen according to one embodiment. In other embodiments, the metering screen may display numeric values on a trace, a table of metered phasors, etc.

Using the event reports 340 option, a user may review event reports 342 or download event reports 344. In the case of devices operating in an electric power system, the event reports 340 may provide information regarding faults, status changes, or other events in the electric power system. The option to download event reports 344 may allow an operator to retain a copy of an event report for later review or analysis or to transfer the report to the receiving device.

Figure 4:
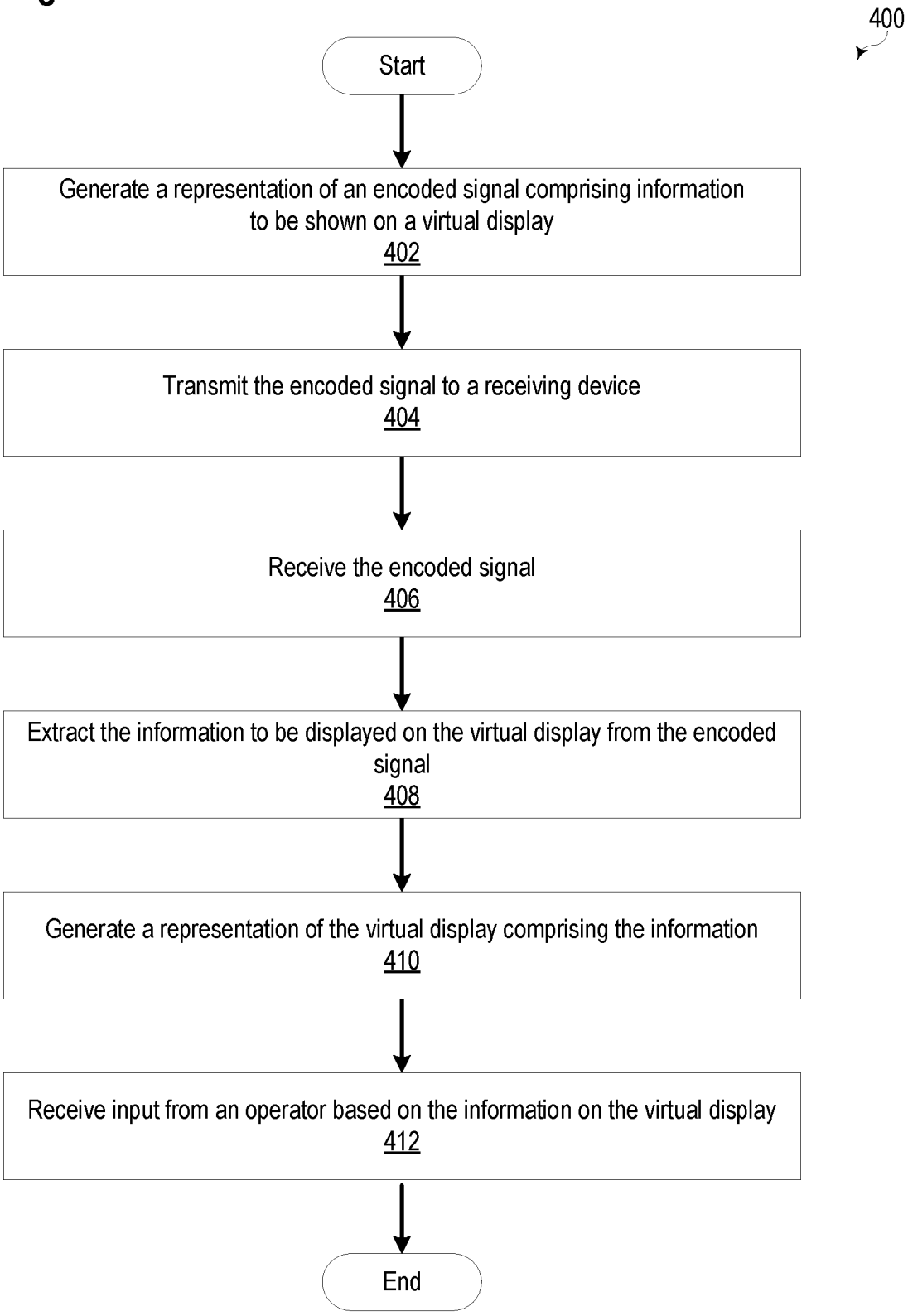
FIG. 4 illustrates a flow chart of a method for generating a virtual display based on an encoded signal received from a transmitting device consistent with embodiments of the present disclosure.

FIG. 4 illustrates a flow chart of a method 400 for generating a virtual display based on an encoded signal received from a transmitting device consistent with embodiments of the present disclosure. At 402, a representation of an encoded signal comprising information to be shown on a virtual display may be generated. The information may comprise a variety of types of information, such as device status, electrical parameter values, status information, a model number, a serial number, a firmware version, event reports, changelogs, a battery status, etc. A processing subsystem, such as processing subsystem 222, illustrated in FIG. 2, may generate the representation of the encoded signal.

At 404, the encoded signal may be transmitted to a receiving device. The encoded signal may be transmitted using a variety of techniques. In one embodiment, the encoded signal may be transmitted using infrared radiation, while in other embodiments, the encoded signal may be transmitted using radio communications. The encoded signal may be created by a virtual display transmission subsystem, such as virtual display transmission subsystem 212, illustrated in FIG. 2. In various embodiments, the transmitting device may lack a receiver of the same type used by the virtual display transmission subsystem. Accordingly, the virtual transmission subsystem may be able to transmit information through a communication channel but may not be capable of receiving information through the communication channel.

At 406, the encoded signal may be received by a virtual display reception subsystem of the receiving device. In various embodiments, the receiving subsystem may be embodied as a smartphone, tablet, or portable computer and/or may be an external receiver in communication with such a device. The receiving subsystem may receive information from the receiving device through a communication channel but may not be capable of transmitting information through the communication channel.

At 408, the information to be displayed on the virtual display may be extracted from the encoded signal. A processing subsystem, such as processing subsystem 240, as illustrated in FIG. 2, may extract the information from the encoded signal. The processing subsystem may translate the encoding or modulation scheme used to encode information in encoded signal 228 to information that may be displayed on the virtual display.

At 410, a representation of the virtual display may be generated. The representation may be generated by a virtual display subsystem, such as virtual display subsystem 242 illustrated in FIG. 2. Specific examples of a virtual display are also shown as screens 314 and 336 illustrated in FIG. 3. A wide variety of information may be presented on a virtual display in various embodiments.

At 412, input from an operator based on information displayed on the information on the virtual display may be received. In various embodiments, the virtual display may be used to navigate menus (e.g., as illustrated in FIG. 3), identify information to be retrieved (e.g., event reports), and/or enter information (e.g., commands) into the transmitting device.

While specific embodiments and applications of the disclosure have been illustrated and described, it is to be understood that the disclosure is not limited to the precise configurations and components disclosed herein. Accordingly, many changes may be made to the details of the above-described embodiments without departing from the underlying principles of this disclosure. The scope of the present invention should, therefore, be determined only by the following claims.

What is claimed is:

1. A system to generate a virtual display, the system comprising:

a transmitting device, comprising:

a processing subsystem to generate a representation of an encoded signal comprising information to be shown on a virtual display;

a virtual display transmission subsystem in communication with the processing subsystem to transmit the encoded signal to a receiving device; and a physical user interface in communication with the processing subsystem to receive input from an operator based on the information displayed on the virtual display; and the receiving device, comprising:

a virtual display reception subsystem to receive the encoded signal;

a processing subsystem to extract the information to be displayed on the virtual display from the encoded signal and to generate a representation of the virtual display; and a virtual display subsystem to display the representation of the virtual display comprising the information;

wherein the virtual display transmission subsystem and the virtual display reception subsystem create a unidirectional communication channel from the transmitting device to the receiving device.

2. The system of claim 1, wherein a transmitter in the transmission subsystem comprises an infrared transmitter and the virtual display reception subsystem comprises an infrared receiver.

3. The system of claim 2, wherein the infrared transmitter is obscured behind a material that is transparent to infrared radiation.

4. The system of claim 1, wherein the virtual display transmission subsystem comprises a visible light transmitter and the virtual display reception subsystem comprises a visible light receiver.

5. The system of claim 1, wherein the receiving device comprises a portable electronic device comprising an application to generate the virtual display.

6. The system of claim 1, wherein the transmitting device operates within a critical infrastructure system.

7. The system of claim 1, wherein the encoded signal comprises a unique identifier associated with the transmitting device.

8. The system of claim 1, wherein the receiving device further comprises a communication subsystem to communicate with an external data source and retrieve information about the transmitting device.

9. The system of claim 1, wherein the encoded signal comprises a stream of status information corresponding to at least one parameter monitored by the transmitting device.

10. The system of claim 1, further comprising a dongle to connect the transmitting device and the receiving device and to conduct the encoded signal from the transmitting device to the receiving device.

11. A method of generating a virtual display, the method comprising:

generating, using a processing subsystem of a transmitting device, a representation of an encoded signal comprising information to be shown on a virtual display;

transmitting, using a virtual display transmission subsystem of the transmitting device, the encoded signal to a receiving device;

receiving, using a virtual display reception subsystem of the receiving device, the encoded signal;

extracting, using a processing subsystem of the receiving device, the information to be displayed on the virtual display from the encoded signal;

generating, using the processing subsystem of the receiving device, a representation of the virtual display comprising the information;

displaying, using a virtual display subsystem of the receiving device, the representation of the virtual display; and receiving input, using a physical user interface in communication with the processing subsystem of the transmitting device, from an operator based on the information displayed on the virtual display;

wherein the virtual display transmission subsystem and the virtual display reception subsystem create a unidirectional communication channel from the transmitting device to the receiving device.

12. The method of claim 11, wherein a transmitter in the transmission subsystem comprises an infrared transmitter and the virtual display reception subsystem comprises an infrared receiver.

13. The method of claim 12, wherein the infrared transmitter is obscured behind a material that is transparent to infrared radiation.

14. The method of claim 11, wherein the virtual display transmission subsystem comprises a visible light transmitter and the virtual display reception subsystem comprises a visible light receiver.

15. The method of claim 11, wherein the receiving device comprises a portable electronic device comprising an application to generate the virtual display.

16. The method of claim 11, wherein the transmitting device operates within a critical infrastructure system.

17. The method of claim 11, wherein the encoded signal comprises a unique identifier associated with the transmitting device.

18. The method of claim 11, wherein the receiving device further comprises a communication subsystem to communicate with an external data source and retrieve information about the transmitting device.

19. The method of claim 11, wherein the encoded signal comprises a stream of status information corresponding to at least one parameter monitored by the transmitting device.

20. The method of claim 11, further comprising connecting a dongle between the transmitting device and the receiving device and to conduct the encoded signal from the transmitting device to the receiving device.

* * * * *